US010797430B2

(12) United States Patent
Shinoda

(10) Patent No.: US 10,797,430 B2
(45) Date of Patent: Oct. 6, 2020

(54) CONNECTOR

(71) Applicant: Sumitomo Wiring Systems, Ltd., Yokkaichi, Mie (JP)

(72) Inventor: Koji Shinoda, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/470,657

(22) PCT Filed: Dec. 8, 2017

(86) PCT No.: PCT/JP2017/044176
§ 371 (c)(1),
(2) Date: Jun. 18, 2019

(87) PCT Pub. No.: WO2018/116869
PCT Pub. Date: Jun. 28, 2018

(65) Prior Publication Data

US 2019/0326704 A1 Oct. 24, 2019

(30) Foreign Application Priority Data

Dec. 20, 2016 (JP) ..... 2016-246915

(51) Int. Cl.
*H01R 13/52* (2006.01)
*H01R 13/405* (2006.01)

(52) U.S. Cl.
CPC ..... *H01R 13/5202* (2013.01); *H01R 13/405* (2013.01)

(58) Field of Classification Search
CPC .. H01R 13/405; H01R 13/52; H01R 13/5202; H01R 13/521; H01R 13/5216
See application file for complete search history.

(56) References Cited

U.S. PATENT DOCUMENTS

2001/0010982 A1 8/2001 Sakaguchi
2004/0002260 A1* 1/2004 Okamoto ..... H01R 43/24 439/606
2004/0029432 A1* 2/2004 Denneler ..... H01R 13/5216 439/426
2005/0142942 A1* 6/2005 Hayashi ..... H01R 13/6592 439/607.01
2008/0012173 A1* 1/2008 Asao ..... B29C 45/14639 264/255

(Continued)

FOREIGN PATENT DOCUMENTS

JP 2000-040551 2/2000
JP 2000-251998 9/2000

(Continued)

OTHER PUBLICATIONS

International Search Report dated Jan. 9, 2018.

*Primary Examiner* — Oscar C Jimenez

(74) *Attorney, Agent, or Firm* — Gerald E. Hespos; Michael J. Porco; Matthew T. Hespos

(57) ABSTRACT

A connector 22 includes a housing 31, a plate 32, a plurality of terminals 33 and a potting material 34. The housing 31 is formed by insert molding with the plate 32 and the plurality of terminals 33 as cores. The housing 31 includes a separation wall 31*b* held in close contact with a first surface 32*a* of the plate 32, and this separation wall 31*b* is held in close contact with side surfaces of the terminals 33.

2 Claims, 6 Drawing Sheets

(56) References Cited

U.S. PATENT DOCUMENTS

| | | | | |
|---|---|---|---|---|
| 2008/0045065 | A1* | 2/2008 | O'Connor | H01R 4/029 439/271 |
| 2008/0274636 | A1* | 11/2008 | Marklove | H01R 13/521 439/271 |
| 2010/0297864 | A1* | 11/2010 | Matsuoka | B29C 45/14639 439/271 |
| 2010/0317228 | A1* | 12/2010 | Ring | H01R 13/405 439/606 |
| 2015/0171543 | A1* | 6/2015 | Sittner | H01R 13/405 439/271 |
| 2015/0236441 | A1* | 8/2015 | Kim | H01R 13/521 439/587 |
| 2015/0280373 | A1* | 10/2015 | Furukawa | H04N 5/2257 439/578 |
| 2017/0025784 | A1* | 1/2017 | Greene | H01R 13/5202 |
| 2019/0123479 | A1* | 4/2019 | Lim | H01R 13/5219 |

FOREIGN PATENT DOCUMENTS

| | | |
|---|---|---|
| JP | 2014-157678 | 8/2014 |
| JP | 2015-065039 | 4/2015 |

* cited by examiner

CONNECTOR

BACKGROUND

Field of the Invention

The invention relates to a connector.

Related Art

Japanese Unexamined Patent Publication No. 2000-40551 discloses a relay connector to be mounted on a device case, such as a transmission case that contains oil. The relay connector is configured for connecting an electrical device arranged inside a device case and a control circuit or the like outside the device case. The connector to be mounted on the device case is waterproofed by a potting material to prevent the leakage of the oil or the like to outside from the device case. Thus, the connector is formed by insert molding to form a housing after terminals are disposed in a mold.

Terminals are arranged one by one in a mold in a connector formed by insert molding, as described above. Thus, labor and time increase for a process of molding a housing with many terminals, and there is a cost increase for the connector.

The invention was developed to solve the above problem and aims to provide a connector enabling a cost reduction.

SUMMARY

A connector solving the above problem includes a plate having a first surface and a second surface. Terminals are press-fit through the plate to penetrate through the plate in a thickness direction of the plate. A housing is formed by insert molding with the plate and the terminals as cores. The housing covers a side surface of the plate and the first surface of the plate, and a potting material is filled into the housing to cover the second surface of the plate.

According to this configuration, the housing is held in close contact with side surfaces of the terminals. Thus, the potting material filled into the molded housing does not flow out toward end parts of the plurality of terminals, and the protrusion of the potting material can be prevented. By forming the housing by insert molding with the plate and the terminals press-fit through the plate as the cores, labor and time in molding are reduced and time required for molding is shortened as compared to the case where the terminals are inserted one by one. The shortening of the time required for molding becomes more remarkable as the number of the terminals increases. As just described, the time and labor in molding are reduced and the time required for molding is shortened, thereby reducing the cost of the connector.

The housing may include a fixing portion to be fit into a mounting hole, and a mounting groove into which a seal ring is disposed is formed over an entire circumference on an outer side surface of the fixing portion. According to this configuration, the housing is fit in the mounting hole in a liquid-tight manner by disposing the seal ring in the mounting groove.

According to connectors in accordance with several aspects of the present invention, cost can be reduced.

DETAILED DESCRIPTION

Note that the accompanying drawings show constituent elements in an enlarged manner to facilitate understanding in some cases. Size ratios of the constituent elements may be different from actual ones or those in different figures.

Figure 1:
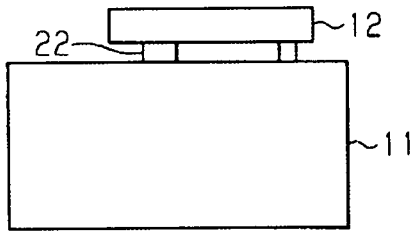
FIG. 1 is a schematic diagram of a device case and a control unit.

As shown in FIG. 1, a control unit 12 is fixed to the top of a device case 11, for example, by screws. The device case 11 is, for example, a transmission case and electrical components, such as a motor and a sensor, are disposed inside. The control unit 12 includes a connector 22 and the connector 22 is inserted in a mounting hole of the device case 11. A control circuit and the like to be connected to the electrical components disposed in the device case 11 are accommodated in the control unit 12. The control circuit and the like are connected to the electrical components in the device case 11 via terminals disposed in the connector 22.

Figure 2:
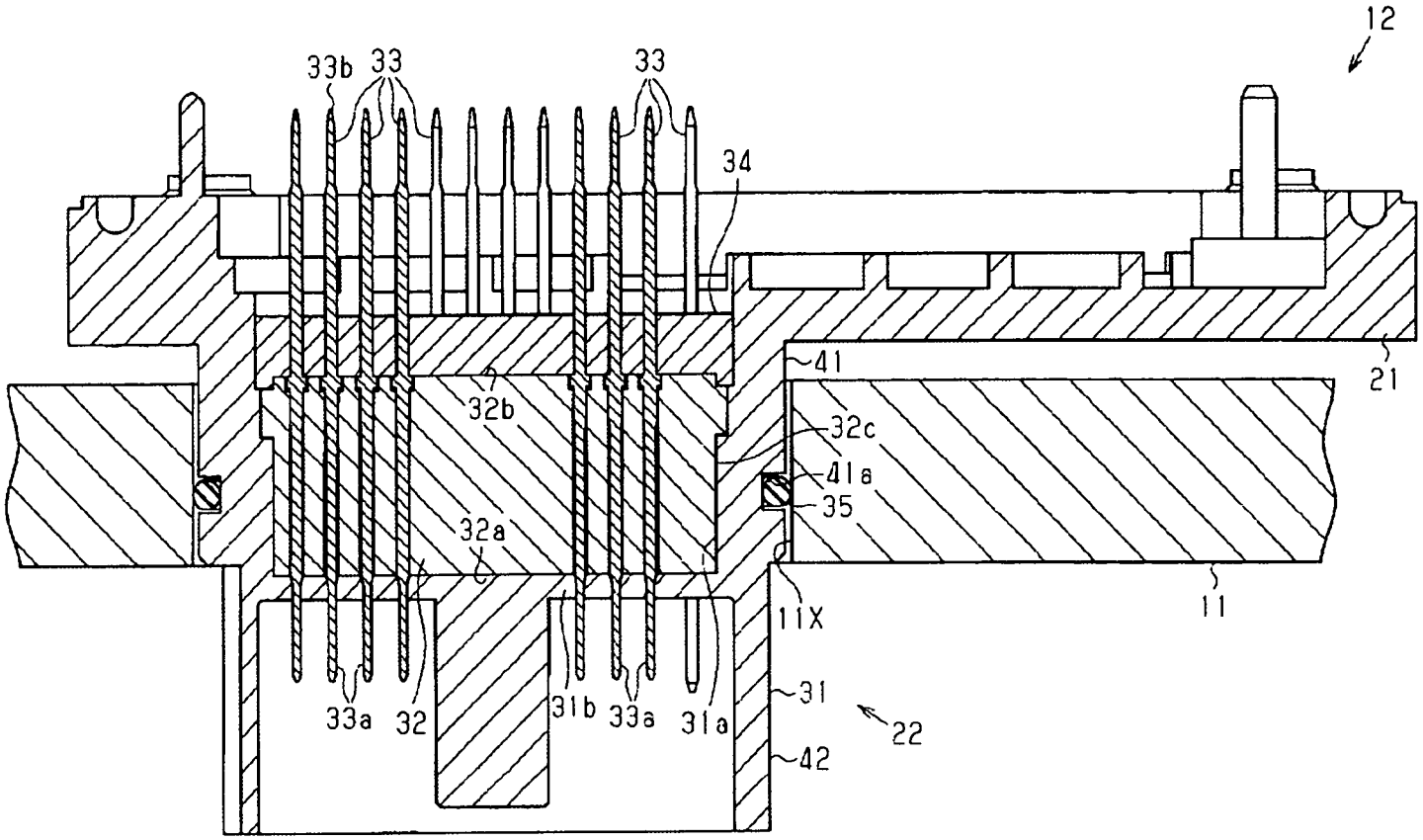
FIG. 2 is a partial section showing the device case and the control unit.

FIG. 2 shows partial cross-sections of a housing 21 of the control unit 12, the connector 22 integrally formed to the housing 21 and the device case 11. Note that the housing 21 shown in FIG. 2 is, for example, a part of a housing formed into a box shape and accommodating the control circuit and the like, and the connector 22 is integrally formed to this part.

The connector 22 is inserted into a mounting hole 11X of the device case 11.

The connector 22 includes a housing 31, a plate 32, terminals 33 and a potting material 34.

Figure 5:
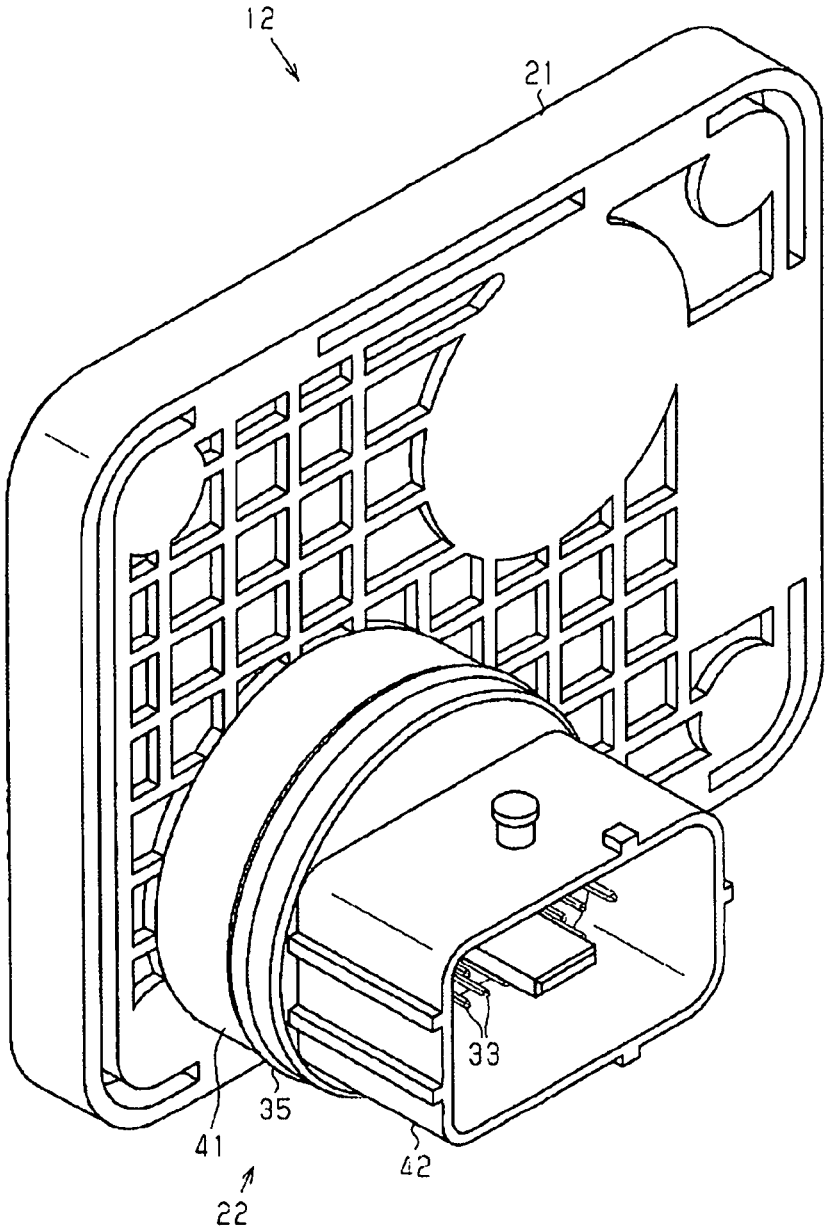
FIG. 5 is a perspective view showing the connector of the control unit.

As shown in FIG. 5, the housing 31 includes a fixing portion 41 disposed in the mounting hole 11X (see FIG. 2) and a fitting portion 42 formed to extend from the fixing portion 41. The fixing portion 41 is, for example, formed into a cylindrical shape. A mounting groove 41*a* is formed over the entire circumference on the outer peripheral surface of the fixing portion 41. A seal ring 35 is disposed in the mounting groove 41*a*. As shown in FIG. 2, the housing 31 is fit in the mounting hole 11X in a liquid-tight manner by the seal ring 35.

As shown in FIG. 5, the fitting portion 42 is formed into a substantially rectangular tube shape. A connector connected to the electrical components arranged inside the device case 11 shown in FIG. 1 is fit to the fitting portion 42.

As shown in FIG. 2, the plate 32 is embedded in the housing 31. The plate 32 is, for example, formed into a rectangular parallelepiped shape. The plate 32 has a first surface 32*a* and a second surface 32*b* facing each other in a thickness direction (vertical direction in FIG. 2). A side surface 32*c* of the plate 32 is held in close contact with an inner surface 31*a* of the housing 31.

The terminals 33 penetrate through the plate 32 in the thickness direction. The terminals 33 are supported by the plate 32 so as to be inserted through the plate 32 by being press-fit through the plate 32.

The housing 31 includes a separation wall 31*b*. The separation wall 31*b* is formed to cover the first surface 32*a* of the plate 32. The separation wall 31*b* is held in close contact with the first surface 32*a* of the plate 32. Further, the separation wall 31*b* is held in close contact with side surfaces of the terminals 33 projecting from the plate 32 without any clearance therebetween.

The potting material 34 is filled into the housing 31 to cover the second surface 32*b* of the plate 32. For example, epoxy resin can be used as the potting material 34. The potting material 34 is filled into the housing 31, for example, in a liquid state and cured, for example, by heating. By this potting material 34, the leakage of liquid such as oil from the device case 11 through penetrating parts of the terminals 33 is prevented.

One end part 33*a* (lower end part in FIG. 2) of each of the terminals 33 is disposed in the housing 31. These end parts 33*a* work as male terminals of the connector 22. As described above, the connector is fit into the fitting portion 42 of the housing 31. Female terminals disposed in this connector and the terminals 33 (male terminals) of the connector 22 are electrically connected. Other end parts 33*b* (upper end parts in FIG. 2) of the plurality of terminals 33 are, for example, connected to a wiring board disposed in the housing 21.

The housing 31 made of synthetic resin is, for example, formed using a mold. The plate 32 and the terminals 33 are disposed as cores in the mold. That is, the housing 31 is formed by insert molding with the plate 32 and the plurality of terminals 33 as the cores. In the housing 31 formed in this way, the separation wall 31*b* is held in close contact with the side surfaces of the terminals 33 projecting from the plate 32 without any clearance therebetween.

The potting material 34 is filled into the housing 31 formed by insert molding to cover the second surface 32*b* of the plate 32. The terminals 33 are press-fit through the plate 32. Thus, the liquid potting material 34 filled into the housing 31 enters clearances between the plate 32 and the terminals 33. The separation wall 31*b* of the housing 31 is held in close contact with the side surfaces of the terminals 33. Thus, the liquid potting material 34 is dammed by the separation wall 31*b*, i.e. the protrusion of the potting material 34 toward the end parts 33*a* is prevented.

Figure 3:
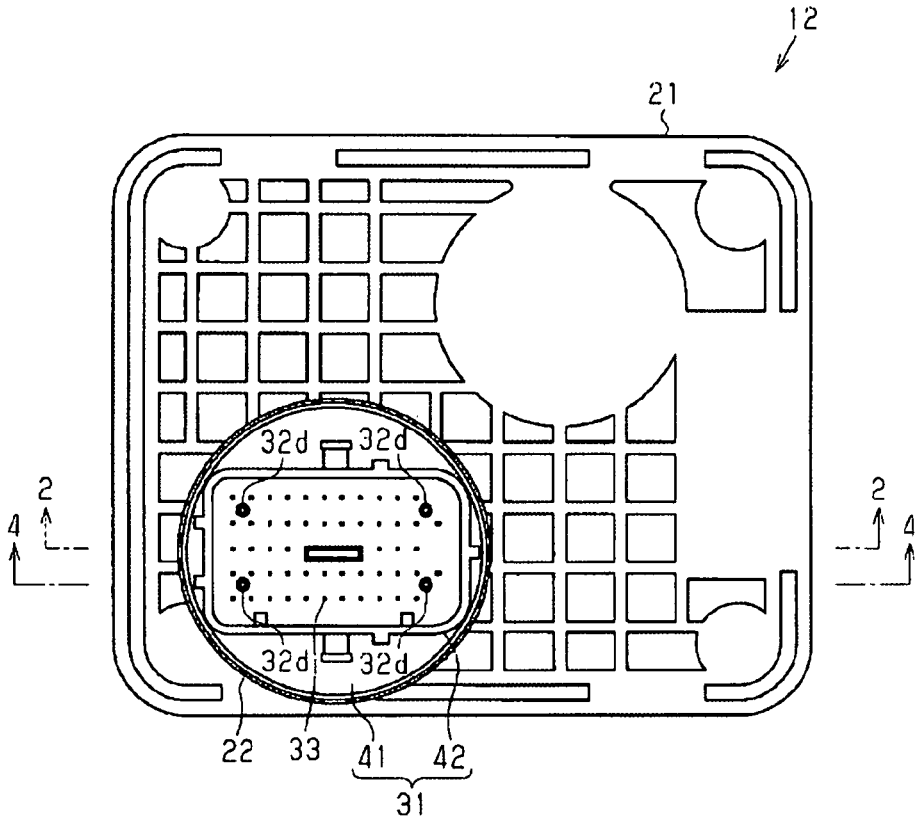
FIG. 3 is a plan view showing a connector of the control unit.
Figure 4:
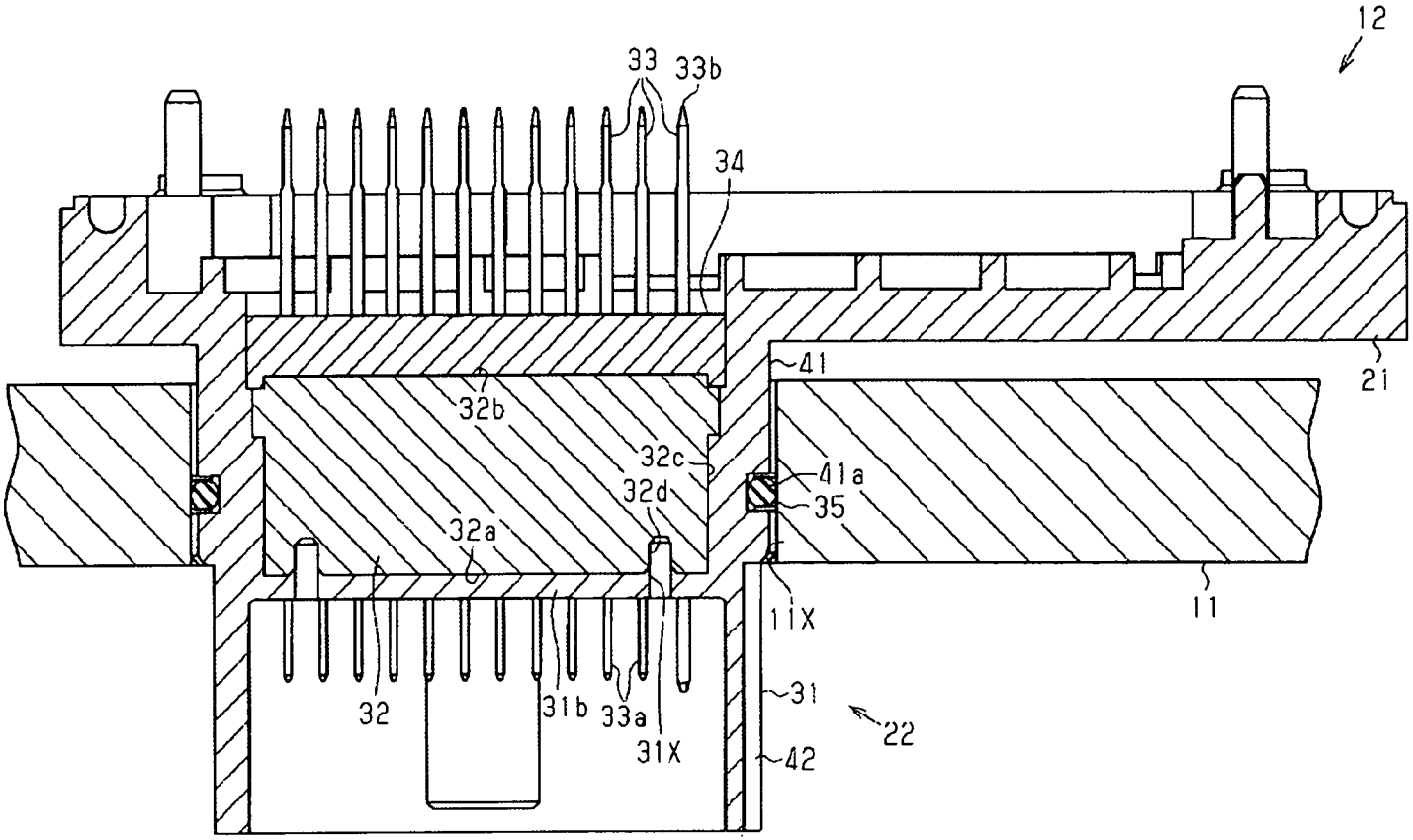
FIG. 4 is a partial section showing the connector of the control unit.

As shown in FIG. 4, recesses 32*d* are formed in the first surface 32*a* of the plate 32. In this embodiment, four recesses 32*d* are formed in the plate 32. As shown in FIG. 4, the separation wall 31*b* is formed with through holes 31X communicating with the recesses 32*d* of the plate 32. As shown in FIGS. 3 and 4, the through holes 31X are formed to avoid the terminals 33 arranged in the connector 22. Note that the recesses 32*d* of the plate 32 shown in FIG. 4 are formed to communicate with the through holes 31X of the separation wall 31*b*. That is, the plate 32 is formed with four recesses 32*d*.

These recesses 32*d* are used to position the plate 32 in a process of forming the housing 31.

Figure 6:
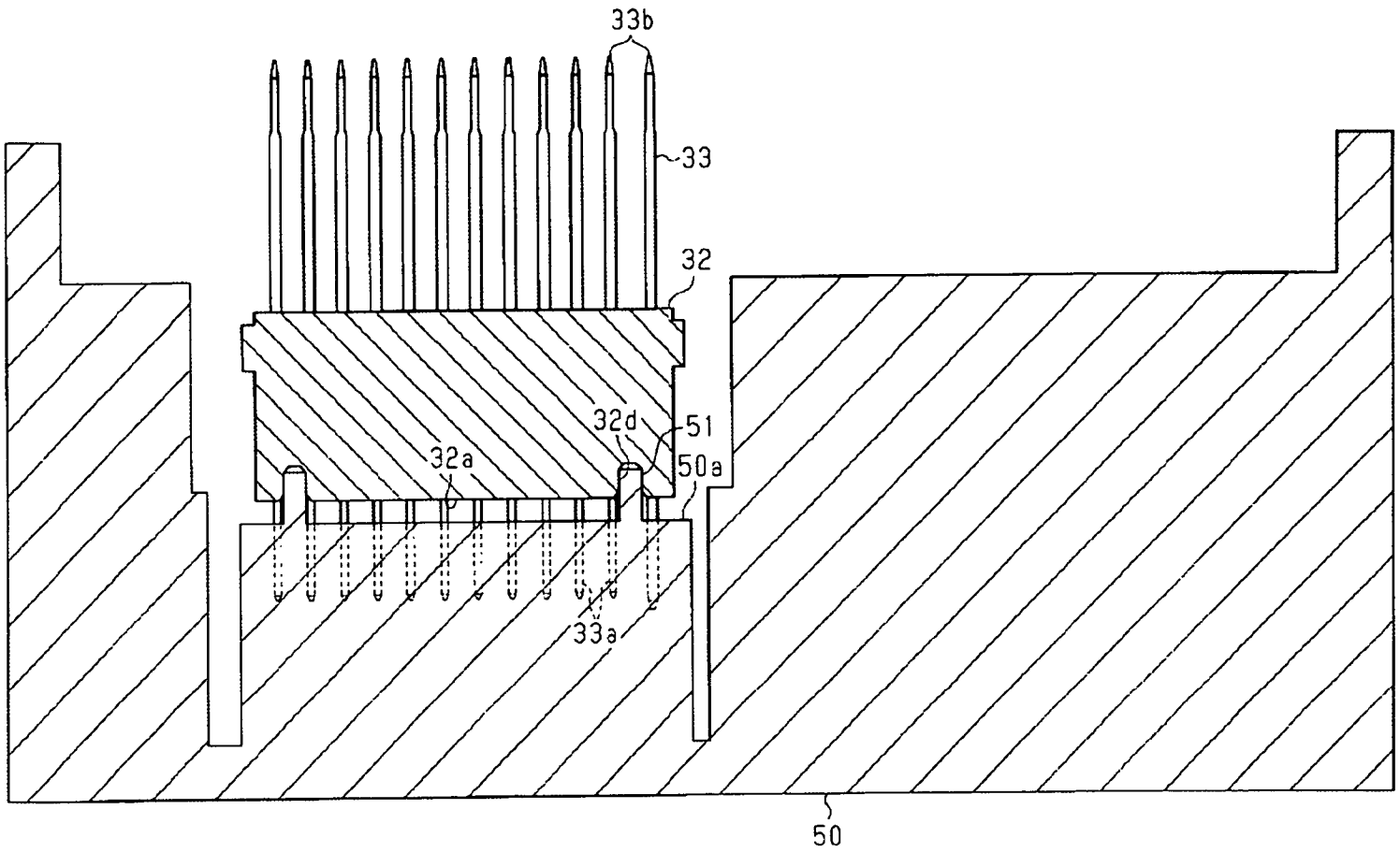
FIG. 6 is a schematic section showing a mold for molding a plate and terminals.

As shown in FIG. 6, a mold 50 is used to form the aforementioned housing 31 (see FIG. 4). Pin-like positioning members 51 stand in this mold 50. These positioning members 51 are inserted into the recesses 32*d* of the plate 32. By the insertion of these positioning members 51, the plate 32 is fixed while being separated from an inner surface 50*a* of the mold 50. By this clearance between the plate 32 and the inner surface 50*a* of the mold 50, the separation wall 31*b* of the housing 31 shown in FIG. 2 is formed. Then, molten resin is injected into the mold 50 to form the housing 31. At this time, since the positioning members 51 are inserted in the recesses 32*d* of the plate 32, the cores, i.e. the plate 32 and the terminals 33 do not move when this resin is injected. The housing 31 is formed by curing the resin. Thus, the separation wall 31*b* of the housing 31 is formed with the through holes 31X corresponding to the positioning members 51.

(Functions)

The housing 31 formed by insert molding with the plate 32 and the terminals 33 as the cores is held in close contact with the side surfaces of the terminals 33. Thus, the potting material 34 filled into the molded housing 31 does not flow out toward the end parts 33*a* of the terminals 33. That is, the protrusion of the potting material 34 is prevented.

The terminals 33 of the connector 22 are press-fit through the plate 32. The terminals 33 can be press-fit through the plate 32 in an arranged state by an automatic machine. Thus, time for press-fitting is short. The housing 31 is formed by insert molding with the plate 32 and the terminals 33 as the cores. Thus, the terminals 33 can be disposed in the mold 50 in a shorter time as compared to insert molding in which the terminals 33 are disposed one by one in the mold 50. Therefore, time required to form the connector 22 is shortened and the cost of the connector 22 is reduced.

The plate 32 includes the recesses 32*d* into which the positioning members 51 of the mold 50 are fit. By these recesses 32*d*, the cores, i.e. the plate 32 and the terminals 33 are positioned in the mold 50. The plate 32 and the terminals 33 do not move when the molten resin for forming the housing 31 is injected into the mold 50. Therefore the housing 31 is formed stably.

As described above, the following effects are exhibited according to this embodiment.

The connector 22 includes the housing 31, the plate 32, the terminals 33 and the potting material 34. The housing 31 is formed by insert molding with the plate 32 and the terminals 33 as the cores. The housing 31 includes the separation wall 31*b* held in close contact with the first surface 32*a* of the plate 32, and this separation wall 31*b* is held in close contact with the side surfaces of the terminals 33. Thus, the potting material 34 filled into the molded housing 31 does not flow out toward the end parts 33*a* of the terminals 33. That is, the protrusion of the potting material 34 can be prevented.

The terminals 33 of the connector 22 are press-fit through the plate 32. The terminals 33 can be press-fit through the plate 32 in an arranged state by the automatic machine. Thus, time for press-fitting is short. The housing 31 is formed by insert molding with the plate 32 and the terminals 33 as the cores. Accordingly, time and labor in molding are reduced and the terminals 33 can be disposed in the mold 50 in a short time as compared to insert molding in which the terminals 33 are disposed one by one in the mold 50. Therefore, the time and labor in molding and the time required to form the connector 22 can be shortened and the cost of the connector 22 can be reduced.

Note that the above embodiment may be carried out as follows.

- The connector 22 integrated with the housing 21 of the control unit 12 is shown in the above embodiment. In contrast, the connector 22 may be formed as a single body. Further, the connector 22 may be integrally formed to a housing of another unit.
- The shapes of the housing 31, the plate 32 and the terminals 33 may be changed appropriately in the above embodiment.
- In the above embodiment, the recesses 32*d* formed in the plate 32 are an example of means for positioning the plate 32 and the terminals 33 in the mold 50. Thus, the recesses 32*d* may be omitted if the plate 32 and the terminals 33 can be positioned. Further, means shaped for positioning other than the recesses 32*d* may be formed in the plate 32.

In the above embodiment, the terminals 33 may be called conductive terminal pins. In the above embodiment, an intermediate part of each terminal 33 between the end parts 33*a* and 33*b* can include a first intermediate part fixedly supported in the plate 32, a second intermediate part held in close contact with the separation wall 31*b* in a liquid-tight manner and a third intermediate part held in close contact with the potting material 34 in a liquid-tight manner.

In FIG. 6, an assembly composed of the terminals 33 and the plate 32 may be called a core assembly. In FIG. 6, a clearance formed by the first surface 32*a* of the plate 32 and the inner surface 50*a* of the mold 50 may be called a first clearance, and the second intermediate parts of the respective terminals 33 are arranged in this clearance. The plate 32 can be formed with pin holes into which the terminals 33 are press-fit. The inner surface 50*a* of the mold 50 can be formed with pin cover holes for covering the end parts 33*a* of the terminals 33.

The disclosure encompasses the following implementation examples. Constituent elements of the embodiment are denoted by reference signs not for limitation, but for assistance for understanding.

In some implementation examples, a connector (22) is used together with a device case (11) including a mounting hole (11X) and is configured to be mounted into the mounting hole (11X) in a liquid-tight manner from the outside of the device case (11), and the connector (22) includes:

a housing (31) having a separation wall (31*b*) serving as a bottom of a recess and an inner surface (31*a*) serving as a side surface of the recess;

a plate (32) having a first surface (32*a*), a second surface (32*b*) and a side surface (32*c*) extending from the first surface (32*a*) to the second surface (32*b*), the plate (32) being held in close contact with the separation wall (31*b*) of the housing (31) without any clearance therebetween over the entire first surface (32*a*) and being held in close contact with the inner surface (31*a*) of the housing (31) without any clearance therebetween over the entire side surface (32*c*);

a potting material (34) held in close contact with the entire second surface (32*b*) of the plate (32) and the entire inner surface (31*a*) of the housing (31) without any clearance therebetween; and conductive terminal pins (33) each having a first end part (33*a*), a second end part (33*b*) and an intermediate part between the first end part (33*a*) and the second end part (33*b*);

the intermediate part of each conductive terminal portion (33) including:

a first intermediate part fixedly supported in the plate (32);

a second intermediate part held in close contact with the separation wall (31*b*) of the housing (31) in a liquid-tight manner; and a third intermediate part held in close contact with the potting material (34) in a liquid-tight manner.

In some implementation examples, the connector (22) is a part of a control unit (12) used together with a vehicle transmission case serving as the device case (11).

In some implementation examples, a manufacturing method for a connector (22) is provided, and the manufacturing method includes:

a preparing step of preparing a core assembly (33+32) by press-fitting conductive terminal pins (33) through pin holes of a plate (32), each of the plurality of conductive terminal pin (33) having a first end part (33*a*), a second end part (33*b*) and a first intermediate part fixedly supported in the pin hole of the plate (32);

an arranging step of arranging the core assembly (33+32) at a predetermined position of a mold (50), the first end parts (33*a*) of the conductive terminal pins (33) being covered by a plurality of pin cover holes formed in an inner surface (50*a*) of the mold (50), a first clearance being formed between a first surface (32*a*) of the plate (32) and the inner surface (50*a*) of the mold (50) and the second intermediate parts of the respective conductive terminal pins (33) being arranged in the first clearance;

an insert molding step of performing insert molding using the mold (50) in which the core assembly (33+32) is arranged at the predetermined position; and a filling step of filling a potting material (34) to be held in close contact with the third intermediate parts of the respective conductive terminal pins (33) in a liquid-tight manner and cover the second surface (32*b*) of the plate (32) while not covering the second end parts (33*b*) of the respective conductive terminal pins (33).

It will be apparent to those skilled in the art that the present invention may be embodied in other specific forms without departing from the technical idea thereof. For example, some of components described in the embodiment (or one or more modes thereof) may be omitted or some components may be combined. The scope of the present invention should be determined with reference to appended claims together with the full range of equivalents to which such claims are entitled.

LIST OF REFERENCE SIGNS

22 . . . connector, 31 . . . housing, 32 . . . plate, 32*a* . . . first surface, 32*b* . . . second surface, 33 . . . terminal, 34 . . . potting material, 35 . . . seal ring, 41 . . . fixing portion, 41*a* . . . mounting groove, 11X . . . mounting hole

The invention claimed is:

1. A connector, comprising:

a plate having a first surface and a second surface spaced apart in a connecting direction and a side surface extending continuously between the first and second surfaces;

terminals press-fit through the plate to penetrate through the plate in the connecting direction;

a housing formed of a first material by insert molding with the plate and the terminals as cores, the housing having a receptacle with at least one inner peripheral wall extending in the connecting direction and a separation wall normal to the inner peripheral wall, the inner peripheral wall entirely covering a side surface of the plate and the separation wall entirely covering the first surface of the plate; and a potting material filled into the housing to entirely cover the second surface of the plate, the potting material being a second material different from the first material.

2. The connector of claim 1, wherein the housing includes a fixing portion to be fit into a mounting hole, a mounting groove formed over an entire circumference on an outer side surface of the fixing portion and a seal ring disposed in the mounting groove.

* * * * *